United States Patent [19]

Roark

[11] 4,053,046

[45] Oct. 11, 1977

[54] PLASTIC FILM WRAPPER

[75] Inventor: Eugene Roark, Waycross, Ga.

[73] Assignee: Jno H. Swisher & Son, Inc., Jacksonville, Fla.

[21] Appl. No.: 709,920

[22] Filed: July 29, 1976

[51] Int. Cl.[2] ..... B65D 3/26

[52] U.S. Cl. ..... 206/274; 206/610; 229/40; 229/87 C

[58] Field of Search ..... 206/274, 498, 271, 275; 229/87 C, DIG. 2, 51 C, 51 AS, 51 TS, 87 R, 40, 51 BP

[56] References Cited

U.S. PATENT DOCUMENTS

| | | | |
|---|---|---|---|
| 2,008,361 | 7/1935 | Lindsey | 206/498 |
| 2,079,328 | 5/1937 | McBean | 206/498 |
| 2,086,735 | 7/1937 | Neumiller | 206/274 |
| 2,491,422 | 12/1949 | Snyder | 206/274 |
| 2,833,404 | 5/1958 | Jacobs et al. | 206/498 |
| 3,092,251 | 6/1963 | Jaggers | 206/498 |
| 3,371,775 | 3/1968 | Butler | 206/264 |
| 3,405,861 | 10/1968 | Bush | 206/498 |

FOREIGN PATENT DOCUMENTS

| | | | |
|---|---|---|---|
| 939,106 | 10/1963 | United Kingdom | 229/DIG. 2 |
| 448,059 | 6/1936 | United Kingdom | 229/87 C |

*Primary Examiner*—William Price
*Assistant Examiner*—Joseph Man- Fu Moy

[57] ABSTRACT

A sealed overlapping edge portion of a tearable plastic film envelope is embossed with a series of closely adjacent grooves which guide a tear across the seal.

7 Claims, 6 Drawing Figures

FIG.3
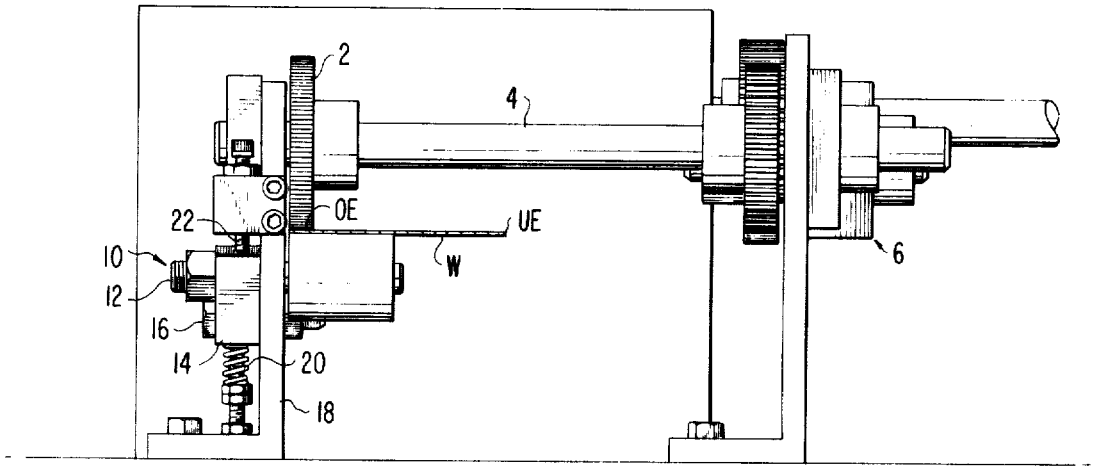
FIG.4
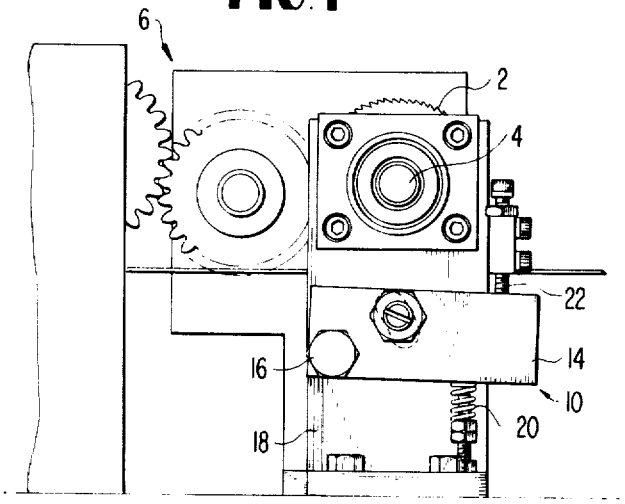
FIG.5
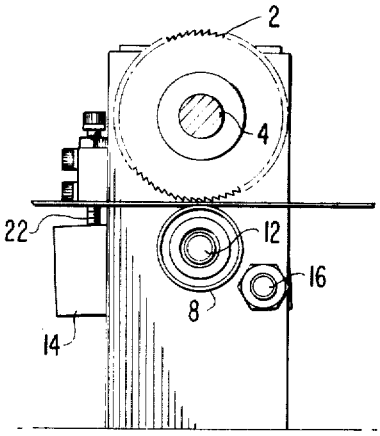
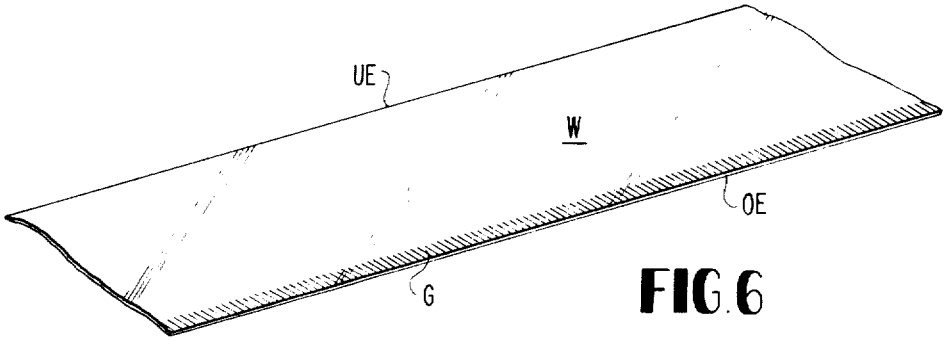
FIG.6

PLASTIC FILM WRAPPER

OBJECTS

Heretofore, the overlapping edge of sealed-seam plastic film wrappers for commodity packages, such as envelopes for cigars, were provided with nicks or cuts to start tears which, once started, were likely to continue, with a relatively straight-sided band of film between them, around the package and back to the sealed seam in or close to the same direction in which they started, and generally opposite the points at which they started. Thus, oftentimes, at least one of the tears did not have to cross a sealed seam two layers thick. This was particularly true with wrappers formed of films which have "gain", such as Cellophane. Usually the wrapper was applied with the grain so oriented as to guide the tears around the envelope. Thus where a cigar envelope had a band end projecting outwardly through the seam, the band end functioned as a pull-tab and the opening tears, once started at the overlapping edge of the envelope, would most likely follow along relative straight lines, and the grain of the film would facillitate passage of a tear through the seam if it reached a point at which the seam was of double thickness. Usually the overlapping edge of the envelope was nicked or slit adjacent the band to facillitate starting of the tears. With the advent of certain films, such as polypropulene, nicks or slits are not reliable devices for starting tears because of the tendency of the material to "heal up" when heat sealed. The main problem arose, however, because such films lack "grain". Because of this the tears are quite likely to wander, so to speak, as they progress around the envelope and end up at locations far from opposite their starting points; and, upon reaching the heat-sealed seam of double thickness (the overlapping and underlapped edge portions), further progress of the tear was most likely to be blocked at the overlapping edge. When that happened in unwrapping a cigar, quite often the end result was that the consumer damaged the cigar in freeing it from the envelope. This invention resides in the devising of a structure wherein no tear-starting nicks or slits in the overlapping edge of a sealed seam wrapper are necessary and wherein, no matter where along the length of the seam the tears wander to, or how wide or narrow the tear band becomes, the tears will proceed through the double-thickness seam.

In accordance with this invention it is intended now to provide a thin film wrapper having sealed together overlapping and underlapping edge portions wherein the overlapping edge portion has a series of minute grooves disposed transversely to the length of the edge. It is preferred that the grooves be embossments. Features of the invention are that the grooves do not interfere with the formation and maintenance of the seal, the grooves need not (and preferably shouldn't) rupture the film, they can be formed along the entire length of the edge of the wrapping material, and only the grooving of one edge is necessary.

These and other objects will be apparent from the following specification and drawing, in which:

FIG. 3 is an end view of the apparatus shown in FIG. 2;

FIG. 4 is a side elevation of the apparatus as seen from the line 4—4 of FIG. 2;

FIG. 5 is a side elevation partly in cross section, of the apparatus as seen from the line 5—5 of FIG. 2; and, FIG. 6 is a perspective view of a length of film incorporating the invention, prior to its formation into an envelope or wrapper.

Figure 1:
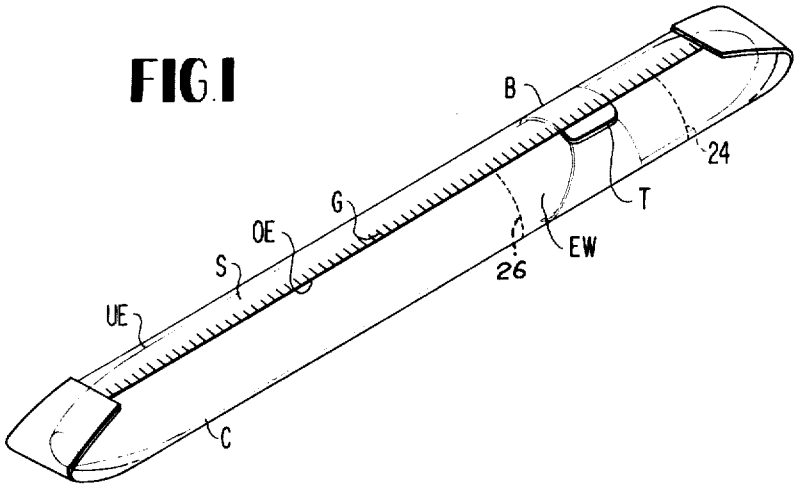
FIG. 1 is a perspective view of a cigar envelope incorporating the invention.
Figure 2:
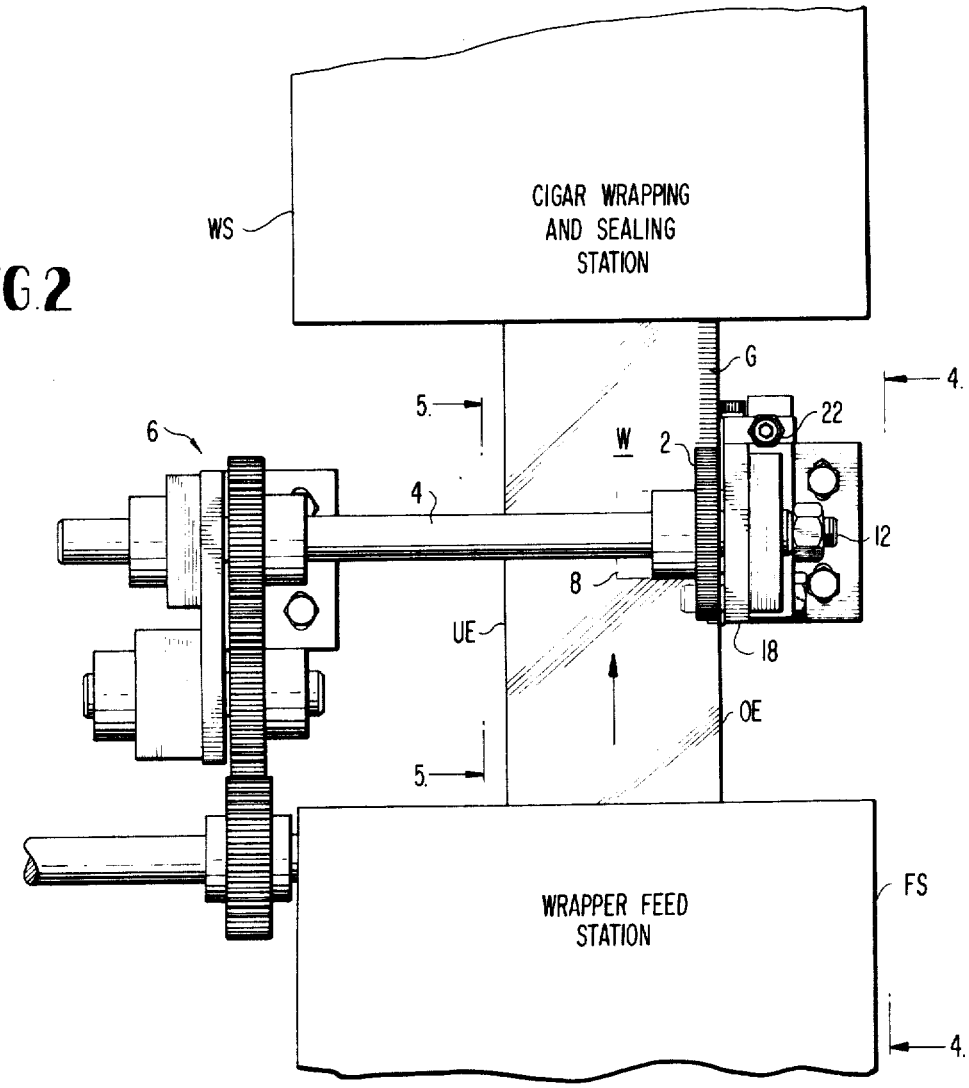
FIG. 2 is a plan view of the apparatus for embossing the grooves in one edge of a film while the latter travels from a supply station to a wrapping station.

Referring now to the drawing, in which like reference numerals denote similar elements, the embossing of grooves G along one edge of the webb W of film from which the envelope or wrapper EW is formed may take place at any stage of handling prior to the wrapping of the cigar C and sealing of the seam. In the formation of an envelope EW for a cigar C, which is the environment in which the subject invention was made, the embossment is made along an edge portion OE of webb W of polypropylene film as the latter comes from the film feed station FS of an envelope wrapping and sealing machine. Such machines, sometimes called "Cellophane machines", are well known in the cigar industry (see, for example, Burns U.S. Pat. Nos. 2,130,729 and 2,178,557). For purposes of this invention, it is sufficient to note that a cigar C is carried in a wrapping pocket to a wrapping station, a band B laid over the cigar C then a lenth of webb W is laid over and wrapped around the band and the cigar, the overlapping edge portion OE is heat sealed over the underlaping edge portion UE to form a seam S along the length of the envelope which is heat sealed, and the ends are tucked back and heat sealed against the exterior of the envelope wrapper EW. An end of the band B projects outwardly beyond seam S and constitutes a pull tab T. Heretofore, slits or nicks were formed in the overlapping edge OE at the edges of band B to facilitate starting of tears.

According to this invention, a series of shallow grooves G are formed in the overlapping edge portion OE of the envelope along seam S. This may be accomplished by means of a toothed wheel 2 disposed over the path of the edge portion OE which is to be the overlapping one. The shaft 4 on which the toothed wheel is affixed is rotated intermittently by the drive mechanism denoted generally at 6 each time a length of the webb W is fed from the feed station FS to the wrapping and sealing station. A resiliently biased back-up or anvil roller 8 forces the edge portion OE against the periphery of toothed wheel 2, the amount of force and hence the depth of grooves G being variable by adjustment of the spring mechanism 10 which biases the back-up roller towards the periphery of the toothed wheel 2. In this embodiment, the roller shaft 12 is mounted on an arm 14 which is pivoted as at 16 on an upright bracket 18. The free end of arm 14 is forced by a compression spring 20 against an adjustable stop 22. Preferably the material is not pressed so hard against the teeth of wheel 2 that they cut completely through the edge portion OE, although this is not a serious problem where the envelope E is formed of polypropylene, which has a tendency to heal up when heat sealed. The teeth of the embossing wheel 2 thin out the material at the groove bottoms, and the groove ends provide sites at which a tear will easily start in a manner comparable to a crease in a paper sheet. The grooves G facilitate starting the tears denoted by broken lines 24 and 26 when tab T is pulled, but the primary function of grooves G is performed at the ends of the tears when they have continued around the envelope and have returned to the double-thickness sealed seam S at locations other than opposite to where pulling of the tear tab T started them.

The grooves G extend inwardly from the overlapping edge and are spaced closely enough so that no matter where along the seam S a tear reaches the overlapping edge OE, the tearing force need be transmitted only a short distance until it reaches the end of a groove G. Absent the grooves, upon reaching the overlapping edge OE which is heat sealed over the underlapped edge UE, a tear is likely to be blocked and will not start into the sealed-together double thickness of the two edges. However, the groove end reached by the tear guides the tear straight into the overlapping edge, and once started, it will follow the groove bottom. In an envelope for a cigar made of polypropylene film of about 85 or 90 gauge thickness, seventeen grooves per inch suffices, although the precise number is not critical. The groove bottoms need not be sharp, and the length of the grooves relative to the width of the heat seal is not critical because once a tear penetrates the overlapping edge, it will have passed the point of greatest resistance and will continue along a groove bottom and therebeyond, to a point where complete removal of the wrapper can be easily accomplished. In the example described herein the grooves are less than ¼ inch long and the overlap of the edges is about 5/16 inch.

While the invention has been exemplified as it applies to a polypropylene film cigar envelope, it can be used on wrappers for various other commodities or containers therefor.

I claim:

1. A plastic wrapper for commodities said wrapper being formed of grainless plastic film having underlapping and overlapping edge portions and a heat seal joining said edge portions together along the length thereof so as to form a double-thickness seam, means for initiating a tear across the overlapping edge portion at one part of the length of the seam, and means spaced along the length of said seam for preventing blocking of the continuation of the tear across the other part of the length of the seam.

2. A wrapper as defined in claim 1, said wrapper being of polypropylene film.

3. A wrapper as claimed in claim 1, said means for initiating a tear comprising a tear tab projecting outwardly from between said overlapping and underlapping edge portions.

4. A wrapper as defined in claim 1, the last-named means comprising a plurality of groove means along the overlapping edge portion extending transversely to the length thereof.

5. A wrapper as claimed in claim 4, said groove means being embossments.

6. A cigar envelope package as claimed in claim 4, said package including a cigar having a band therearound within said wrapper, the means for initiating a tear across said seam comprising a tab end of said band which projects outwardly from between said overlapping and underlapping edges.

7. A cigar envelope package comprising a wrapper formed of thermoplastic grainless plastic film having overlapping and underlapping edge portions joined by a heat seal to provide an elongate double-thickness seam, means for initiating a tear across the overlapping edge portion at one part of said seam, and a plurality of closely-spaced groove means extending transversely to the length of the overlapping edge portion disposed along the entire length of said overlapping edge portion for preventing blocking of the continuation of the tear across the other part of the seam.

* * * * *